United States Patent [19]

Roehling et al.

[11] Patent Number: 4,918,269

[45] Date of Patent: Apr. 17, 1990

[54] GAS-BLAST CIRCUIT BREAKER

[75] Inventors: Christoph Roehling; Bernd Bruchmann, both of Berlin, Fed. Rep. of Germany

[73] Assignee: Siemens Aktiengesellschaft, Berlin and Munich, Fed. Rep. of Germany

[21] Appl. No.: 282,153

[22] Filed: Dec. 9, 1988

[30] Foreign Application Priority Data

Mar. 23, 1988 [DE] Fed. Rep. of Germany ... 8804108[U]

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS 4,293,750 10/1981 Marin ..... 200/148 A

FOREIGN PATENT DOCUMENTS 2907691 9/1980 Fed. Rep. of Germany .

*Primary Examiner*—Robert S. Macon

[57] ABSTRACT

A blast arrangement for gas-blast circuit breakers including a blast cylinder and a blast plunger, the blast plunger being designed in two pieces, arranged axially, the two pieces being rigidly coupled via spacers parallel to the axis and holding between them the sealing rings which form a return valve.

17 Claims, 2 Drawing Sheets

GAS-BLAST CIRCUIT BREAKER

BACKGROUND OF THE INVENTION

The invention relates to a gas-blast circuit breaker with a blast arrangement associated to the contact system.

Gas-blast circuit breaker of this type are known as shown in U.S. Pat. 4,293,750 corresponding to the German Patent 2,907,691, wherein a one piece ring plunger holds the sealing rings in annular grooves.

BRIEF DESCRIPTION OF THE INVENTION

The invention provides for a gas-blast circuit breaker with a blast arrangement associated to the contact system, comprising a ring plunger and a movable cylinder, in which the ring plunger is sealed off tightly by a sealing ring against the cylinder, on one side and by a sealing ring against the movable cylindrical contact member of the contact system on the other side, and a return valve closed during the pressure phase and open during the suction phase, which is formed by the two flush-lying sealing rings arranged with axial play in the recesses of the ring plunger, in the line of the flow paths for the compressed gas.

An object of the present invention is to facilitate the manufacture of the ring plunger and to simplify the assembly of the sealing arrangement. Accordingly, the plunger is designed in two pieces arranged along an axis and its two pieces are rigidly connected via spacers arranged parallel to the axis to hold the sealing rings between them.

An advantage of the present invention is that the two plunger parts can be made of different materials. For example, the first plunger piece, which faces away from the compression chamber can be made from a metallic material, while the second plunger piece, which is turned toward the compression chamber, can be made from an insulating material, a casting resin, or a metallic material. Spacer bolts with surrounding spacing tubes are used as spacing devices to establish the distance between the two plunger parts.

Another advantage of the invention is that the outer sealing ring, which operates upon a pushing force in the circumferential direction, can have a coil spring operable within a ring separation. The spring can be positioned in aligning bored holes of the ring body located at the ring separation, wherein the spring can be enveloped by a sliding tube that bridges the ring separation.

Another advantage of the invention is that the inner sealing ring operates upon a pulling force in the circumferential direction, and an annular groove can be provided in the sealing ring opposite the sealing surface, wherein the annular groove is designed to receive an annular spring. The annular spring may take the form of a cylindrical coil spring.

Further details and advantages of the embodiment in accordance with the invention are described with reference to the drawing.

DETAILED DESCRIPTION OF THE PREFERRED EMBODIMENT

Figure 1:
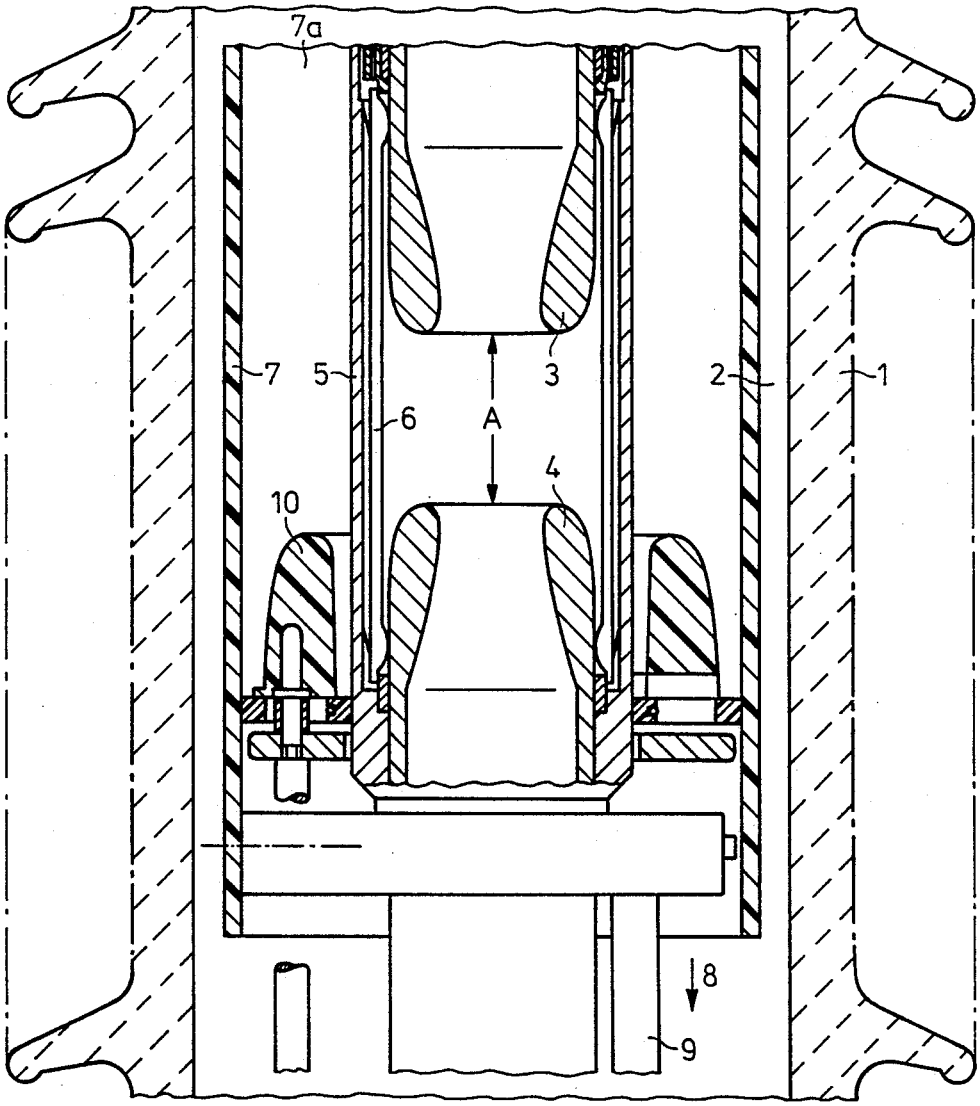
FIG. 1 shows section-view through an electrical gas-blast circuit breaker with a ring plunger arrangement in accordance with the invention.

In FIG. 1, a gas-blast power circuit breaker of the blast plunger circuit breaker type is shown in longitudinal section, in the switched-on position. Within a circuit breaker chamber 1 of porcelain, two hollow, tubular contact members 3, 4 are separated and arranged along an axis in a gas-filled interior space 2. By way of example, the gas can be $SF_6$ under a pressure of 6 bars. The distance A between the frontal surfaces of the contact members 3 and 4 constitutes the separation gap of the circuit breaker in the switched-off state.

In the switched-on state, the two contact members 3, 4 are bridged by the movable bridging contact member 5, which is designed in tubular form and contains several spring-loaded contact blades 6 distributed evenly over the circumference. The movable contact member 5 is mechanically coupled with a blast cylinder 7 which is moved in the direction of the arrow 8 by bars 9 via a drive (not shown herein) when the circuit breaker is moved from the illustrated switched-on state to the switched-off state. During this process, the blast cylinder 7 is pulled over a relatively stationary ring plunger 10, which compresses the extinguishing and insulating means contained in the cylinder space 7*a* until it becomes effective, after the contact separation, to extinguish the arc.

Figure 2:
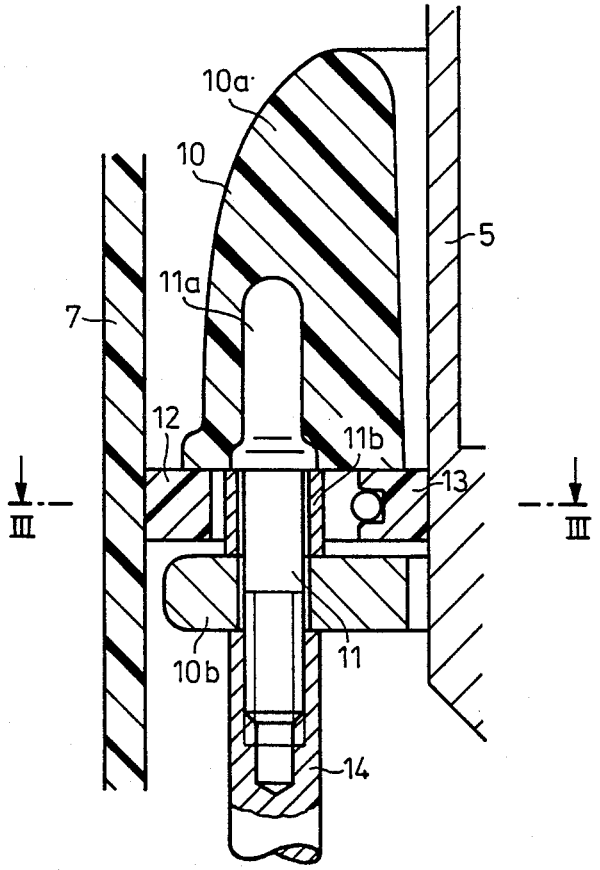
FIGS. 2 and 3 show details of FIG. 1 on an enlarged scale and in section.

As shown schematically and in detail in FIG. 2, the ring plunger 10 is designed in two pieces, arranged axially, wherein the two parts 10*a* and 10*b* rigidly coupled parallel to the axis via spacers 11. The sealing rings 12, 13 are held between the two plunger parts 10*a* and 10*b* such that the rings have axial play. The spacers 11 include spacing bolts 11*a*, encircled by spacing tubes 11*b*. The length of the spacing tubes 11*b* relative to the thickness of the sealing rings 12, 13 determines the axial play of the two sealing rings 12, 13.

The first plunger piece 10*b*, which is turned away from the compression chamber 7*a*, is made of a metallic material in the illustrated embodiment, while the second plunger piece, 10*a*, turned toward the compression chamber 7*a*, is made of an insulating material. The plunger piece 10*a* can also be made of a metal such as aluminum. The two plunger pieces 10*a*, 10*b* are fastened together by means of bars 14 which keep the plunger 10 fixed in place relative to the blast cylinder 7.

Figure 3:
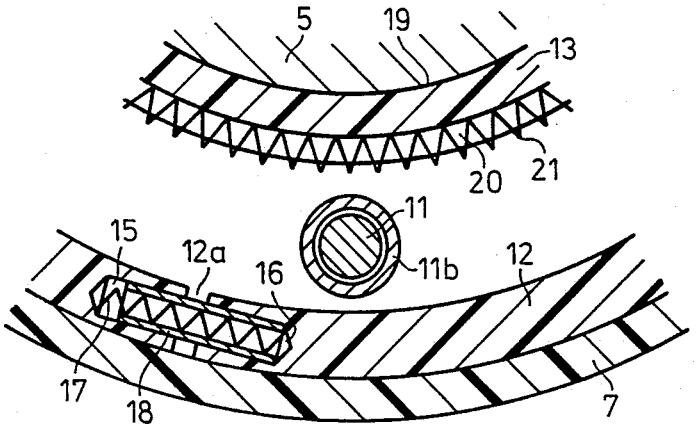

FIG. 3, in a section view rotated 90°, along the Line III—III of FIG. 2, illustrating the outer sealing ring 12, operating upon a pushing force in the circumferential direction, and having, within the range of a ring separation 12*a*, aligned bored holes 15, 16 located in the ring body. A compression spring in the form of a coil spring 17 is located within the aligned bored holes 15, 16. The spring 17 is enveloped by a sliding tube 18 that bridges the ring separation 12*a*.

The inner sealing ring 13, which operates upon pulling force in the circumferential direction, has an annular groove 20 opposite the sealing surface 19, designed to receive an annular spring 21, which in the illustrated embodiment is a cylindrical coil spring.

In FIGS. 1 through 3, the same parts are marked with the same reference symbols.

We claim:

1. A gas-blast circuit breaker with a blast arrangement associated to the contact system, comprising:

a movable tubular contact member;

a movable cylinder; and a ring plunger including recesses, a first sealing ring adjacent to the cylinder for sealing and a second sealing ring adjacent to the movable tubular contact member for sealing;

the sealing rings being arranged with axial play in the recesses of ring plunger to function as a return valve, in the line of the flow paths for the compressed gas, closed during the pressure phase and open during the suction phase;

wherein the ring plunger comprises a first piece and a second piece arranged along an axis and rigidly coupled by spacers arranged parallel to the axis, the sealing rings being held between the pieces.

2. The gas-blast circuit breaker of claim 1, wherein the spacers comprise a plurality of spacer bolts and a plurality of spacing tubes.

3. The gas-blast circuit breaker of claim 1, wherein the first piece is made of a metallic material.

4. The gas-blast circuit breaker of claim 2, wherein the first piece is made of metallic material.

5. The gas-blast circuit breaker of claim 1, wherein the second piece is made of an insulating material.

6. The gas-blast circuit breaker of claim 2, wherein the second piece is made of an insulating material.

7. The gas-blast circuit breaker of claim 3, wherein the second piece is made of an insulating material.

8. The gas-blast circuit breaker of claim 1, wherein the first sealing ring includes a ring separation, a first aligning bore and a second aligning bore each located at the ring separation, a sliding tube slidable within the aligning bore such that it bridges the ring separation and a coil spring located within the sliding tube, the coil spring expanding the first sealing ring in the circumferential direction.

9. The gas-blast circuit breaker of claim 7, wherein the first sealing ring includes a ring separation, a first aligning bore and a second aligning bore each located at the ring separation, a sliding tube slidable within the aligning bore such that it bridges the ring separation and a coil spring located within the sliding tube, the coil spring expanding the first sealing ring in the circumferential direction.

10. The gas-blast circuit breaker of claim 1, wherein the second sealing ring includes an annular groove located opposite the contact member and an annular spring located within the annular groove, the annular spring contracting the second sealing ring in the circumferential direction.

11. The gas-blast circuit breaker of claim 7, wherein the second sealing ring includes an annular groove located opposite the contact member and an annular spring located within the annular groove, the annular spring contracting the second sealing ring in the circumferential direction.

12. The gas-blast circuit breaker of claim 9, wherein the second sealing ring include an annular groove located opposite the contact member and an annular spring located within the annular groove, the annular spring contracting the second sealing ring in the circumferential direction.

13. The gas-blast circuit breaker of claim 10, wherein the annular spring is a cylindrical coil spring.

14. The gas-blast circuit breaker of claim 11, wherein the annular spring is a cylindrical coil spring.

15. The gas-blast circuit breaker of claim 12, wherein the annular spring is a cylindrical coil spring.

16. The gas-blast circuit breaker of claim 3, wherein the second piece is made of a metallic material.

17. The gas-blast circuit breaker of claim 4, wherein the second piece is made of a metallic material.

* * * * *